US007073544B2

(12) United States Patent
Geltser et al.

(10) Patent No.: US 7,073,544 B2
(45) Date of Patent: Jul. 11, 2006

(54) METHOD AND SYSTEM FOR HIGH-SPEED TABLET COUNTING AND DISPENSING

(75) Inventors: Aleksandr Geltser, Stamford, CT (US); Vladimir Gershman, Stamford, CT (US)

(73) Assignee: Kirby Lester, Inc., Stamford, CT (US)

( * ) Notice: Subject to any disclaimer, the term of this patent is extended or adjusted under 35 U.S.C. 154(b) by 0 days.

(21) Appl. No.: 11/120,058

(22) Filed: May 2, 2005

(65) Prior Publication Data

US 2005/0189365 A1 Sep. 1, 2005

Related U.S. Application Data

(63) Continuation-in-part of application No. 10/430,117, filed on May 6, 2003, now Pat. No. 6,899,144, which is a continuation-in-part of application No. 09/975,608, filed on Oct. 11, 2001, now Pat. No. 6,684,914.

(51) Int. Cl.
*B67C 3/02* (2006.01)

(52) U.S. Cl. ..... 141/122; 141/2; 141/18; 141/104; 141/105; 53/493; 53/501; 221/129; 221/133

(58) Field of Classification Search ..... 141/1, 141/2, 18, 83, 94, 100–107, 129, 130, 192; 221/7, 9, 123, 129, 133; 53/52, 168, 493, 53/495, 501
See application file for complete search history.

(56) References Cited

U.S. PATENT DOCUMENTS

| | | | | |
|---|---|---|---|---|
| 3,557,889 A | | 1/1971 | Rejsa | 177/1 |
| 4,267,894 A | | 5/1981 | Hirano et al. | 177/25 |
| 4,398,613 A | | 8/1983 | Hirano | 177/25 |
| 4,577,707 A | | 3/1986 | Fukuda | 177/25 |
| 4,610,323 A | | 9/1986 | Chenowth et al. | 177/25 |
| 4,645,019 A | | 2/1987 | Minamida | 177/25 |
| 5,348,061 A | | 9/1994 | Riley et al. | 141/104 |
| 5,481,855 A | | 1/1996 | Yuyama | 53/493 |
| 5,720,154 A | | 2/1998 | Lasher et al. | 53/411 |
| 5,771,657 A | * | 6/1998 | Lasher et al. | 53/55 |
| 5,966,910 A | * | 10/1999 | Ribani et al. | 53/560 |
| 6,161,721 A | | 12/2000 | Kudera et al. | 221/9 |
| 6,237,804 B1 | | 5/2001 | Peery et al. | 22/17 |
| 6,421,584 B1 | | 7/2002 | Norberg et al. | 700/242 |
| 6,684,914 B1 | | 2/2004 | Gershman et al. | 141/2 |

* cited by examiner

*Primary Examiner*—Timothy L. Maust
(74) *Attorney, Agent, or Firm*—Gordon & Jacobson, P.C.

(57) ABSTRACT

A medicament tablet dispensing system and method dispenses any selected number of tablets, up to a maximum number, without a substantial delay associated with counting all of the tablets. A preset number of tablets are counted and stored in dedicated primary chambers. Furthermore, an overflow chamber is provided for temporarily storing and then dispensing tablets which are fed to the primary chamber after the primary chambers are filled with their respective number of tablets. In addition, a direct feed channel is provided for dispensing individually counted tablets. The chambers and direct feed channel can together dispense the selected number. It is also preferable that the chambers have subchambers, and that more than one subchamber be capable of being emptied during a single dispensing operation.

10 Claims, 8 Drawing Sheets

METHOD AND SYSTEM FOR HIGH-SPEED TABLET COUNTING AND DISPENSING

This application is a continuation-in-part of U.S. Ser. No. 10/430,117, filed on May 6, 2003 now U.S. Pat. No. 6,899,144, which is a continuation-in-part of Ser. No. 09/975,608, filed Oct. 11, 2001 now U.S. Pat. No. 6,684,914, each incorporated by reference herein in its entirety.

BACKGROUND OF THE INVENTION

1. Field of the Invention

This invention relates broadly to medicament tablet counting and dispensing apparatus. More particularly, this invention relates to tablet feeding and counting apparatus which are adapted to dispense any selected number of tablets, up to a maximum number, without a delay associated with counting the tablets.

2. State of the Art

In retail, hospital, and mail order medication dispensing, a large number of different prescriptions of single dose medications, such as tablets, must be filled. (Hereinafter, reference to "tablets" should be understood for purposes herein as being generic to tablets, capsules, caplets and any other solid dose medication).

Larger quantity prescriptions are often filled with the aid of a counting apparatus intended to more rapidly count different quantities of different tablets successively. For example, a prescription for ninety tablets of 10 mg Claritin® may need to be filled after a prescription for sixty tablets of 400 mg Motrin®.

With an automatic tablet counter, the pharmacist obtains a bulk container of a prescription medication from a shelf and then pours from the container a quantity of tablets into a hopper of the counting apparatus. The pharmacist then sets the counting apparatus to the number of tablets to be counted, e.g., ninety. Assuming at least the required number of tablets for the prescription has been poured into the hopper, the pharmacist waits while the counting apparatus counts the required number of tablets and dispenses the tablets into a patient prescription bottle. The excess tablets are discharged back into the bulk container, which is then replaced on the shelf. It has been found that the time taken to discharge the excess tablets can be equal to or greater than the time required to count the prescription.

Each prescription medication must be obtained from a bulk storage container located in stock, which must be opened prior to use and closed after use. In order to minimize the time taken to dispense a prescription, counter manufacturers have provided "cassette counters" for retail, hospital, and mail order pharmacies. Each cassette is designed for a specific size and shape capsule, tablet, or caplet. The cassettes are pre-filled by the pharmacist with bulk quantities of the appropriate prescription drugs, and are used to store bulk quantities rather than using the container supplied by the manufacturer. The prescription medication is then dispensed directly from the cassette. The use of cassettes eliminates the time needed to open the manufacturer's original container, the time needed to return excess tablets to the container, and the time needed to close the container.

However, there are situations, particularly in bulk mail order pharmacies and high volume hospital dispensing, where greater dispensing speed is desired than is currently provided by automatic dispensing systems, particularly for the most frequently dispensed medications.

SUMMARY OF THE INVENTION

It is therefore an object of the invention to provide a system for dispensing a selected quantity of tablets extremely rapidly, irrespective of the type of tablet and the quantity of tablets dispensed.

It is another object of the invention to provide a system for dispensing tablets which functions with all tablets regardless of size, shape, and weight.

It is an additional object of the invention to provide a system for dispensing tablets which is not prone to clogging.

It is a further object of the invention to provide a system for dispensing tablets which is efficient.

In accord with these objects, which will be discussed in detail below, a system and method for storing and dispensing discrete objects, such as 'tablets' (stated above to be generic for tablets, capsules, caplets and any other solid dose medication), is provided and adapted to dispense a number of tablets, up to a maximum number, without a delay associated with counting the tablets.

The system and methodology include first counting and storing a preset number of tablets in respective dedicated chambers (storage locations), the combination of the numbers of tablets within the chambers being useful for dispensing commonly prescribed numbers of tablets.

According to one embodiment of the invention, n chambers are provided, with $2^0, 2^1, 2^2, \ldots, 2^{n-1}$ tablets provided respectively in the individual chambers. Using such a system, any number of tablets, up to the additive combination of all the chambers (e.g., where n=7, the additive combination is 127), can be dispensed from the chambers by selectively emptying the chambers which together add up to the selected number for dispensing.

Because the number of tablets in each of the chambers is always the same, the system optionally can be hardwired to select the tablets from the required chambers without any combinatorial computation process; i.e., for any number of tablets selected for dispensing, there always exists a particular readily determinable combination of chambers which can be emptied to comprise the selected number of tablets exactly. Alternatively, the chambers can be selected by a simple computational process; i.e., first identifying the chamber having the largest number of tablets less than the selected number for dispensing, then identifying the chamber having the next largest number of tablets, provided that the addition of such number of tablets to the previously identified chamber does not exceed the selected number for dispensing, then identifying the chamber having the next largest number of tablets, provided that the addition of such number of tablets to the previously identified chambers does not exceed the selected number for dispensing, etc., until the desired number of tablets has been identified. As each chamber is identified, or after all have been identified, the exit gates are released, preferably in succession, to dispense the tablets.

According to another embodiment of the invention, there are n chambers, where n preferably equals at least four, and the number of tablets in a particular chamber i is preferably $2^{i+2}$, where i=1 . . . n. In accord with this embodiment, a direct feed channel is provided in addition to the chambers. The direct feed channel feeds individually counted tablets into an exit chute in combination with the tablets dispensed from the chambers. The direct feed channel is primarily provided for counting up to $2^{i+2}-1$ tablets, where i preferably equals one, e.g., seven tablets. As such, the direct feed channel in combination with the chambers permits dispensing of any number of tablets up to $$\sum_{i=1}^{n} 2^{i+2} + 7;$$

e.g. where n=4, up to 127 tablets. However, it is certainly appreciated that the chambers may store a non-exponentially incremented number of tablets, and that the direct feed channel may be used to supply up to another number of tablets.

After the selected chambers are emptied tablets are fed from a feeder which stores bulk quantities of the tablet, counted, and directed into the emptied chambers to refill the chambers with the preset number of tables. The direction of the tablets into the emptied chambers for filling is preferably controlled by refill gates which open to receive or direct the required number of tablets and close once appropriately refilled. It is appreciated that only those chambers which are emptied after dispensing need to be refilled and, as such, only the number of tablets in those storage locations need to be counted.

According to another aspect of the invention, each chamber i may include subchambers which are each filled with the appropriate number of tablets for the chamber. Then, when activated, a subchamber of the chamber is emptied. The remaining filled subchambers are then ready for subsequent dispensing while the emptied subchamber is being refilled. As such, the user is not required to wait before attempting to dispense another prescription for the tablets. Moreover, during a single dispensing operation more than one subchamber of a chamber may be emptied, particularly when large numbers of tablets are to be dispensed.

In addition, an overflow chamber may be provided for extra tablets which are inadvertently fed into the refill system after the required count to fill one or more of the chambers has been met. A count is kept of the tablets in the overflow chamber, and the overflow chamber is emptied during the subsequent dispensing or when the number therein is suitable in combination with one or more other chambers to meet an input number of tablets for dispensing.

The system may include a plurality of cells, each including a plurality of chambers for a different solid dose medication. The solid dose medication may then be selected along with the number of tablets required to be dispensed.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
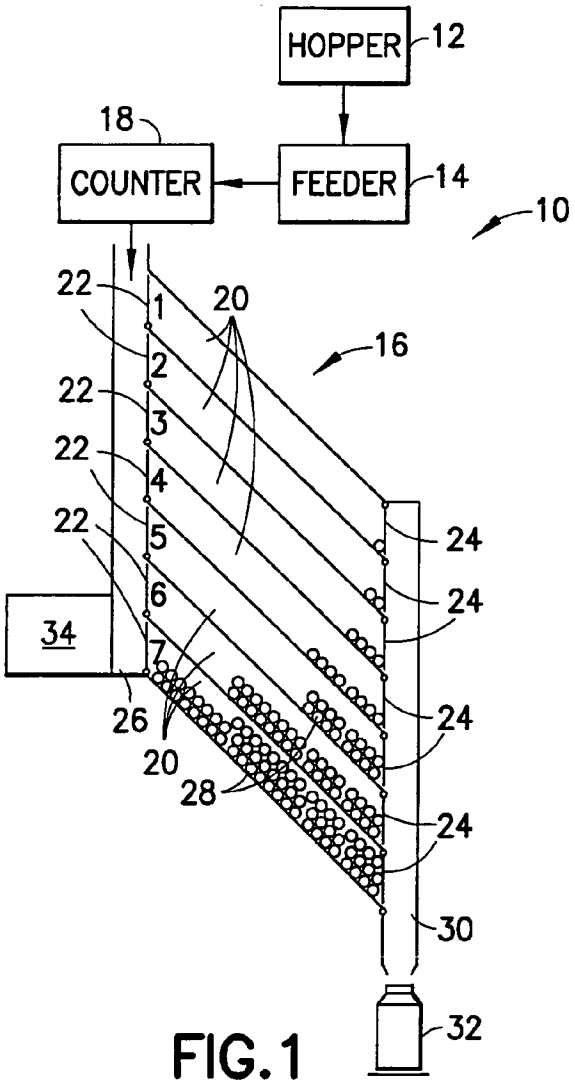
FIG. 1 is a schematic view of an object counting and dispensing system according to the invention including a cell provided with chambers having tablets.

Turning now to FIG. 1, a tablet dispensing system 10 is shown which includes a hopper 12 which stores a bulk quantity of tablets, a feeder 14 which feeds tablets from the hopper 12 to a cell 16, which is described in more detail below, a counter 18 which counts the tablets fed by the feeder to the cell 16, and a controller 34 which operates the cell 16 and permits a user to enter or select the number of tablets to be dispensed.

The hopper 12, feeder 14 and counter 18 may be of any type known in the art suitable for counting small discrete objects, such as tablets. For example, the hopper 12 and feeder 14 may be a vibratory bowl feeder, a mechanical feeder, or a cassette system such as described in co-pending U.S. Ser. No. 09/871,531, filed May 31, 2001, which is hereby incorporated by reference herein in its entirety, each of which may have an integrated unit which functions as both a hopper and a feeder. The counter 18 is preferably an optical system which uses an optical sensor array, such as that disclosed in co-owned U.S. Pat. No. 5,768,327, which is hereby incorporated by reference herein in its entirety. The optical sensor array of U.S. Pat. No. 5,768,327 includes an orthogonal arrangement of two discrete optical sensors which together sense objects in three dimensions. This sensor arrangement is adapted to sense multiple objects simultaneously falling past the sensors.

The cell 16 includes a plurality of vertically-stacked inclined chambers (storage locations) 20 positioned below the counter 18. Seven chambers sequentially numbered one through seven are shown in the embodiment of FIG. 1. The chambers 20 each have a fill gate 22 and an exit gate 24. When the fill gate 22 of any chamber is open, that chamber is in communication with a feed chute 26 and thereby adapted to receive tablets 28 fed from the feeder 14 and counted by the counter 18. With the respective exit gates 24 closed, each chamber 20 stores a predetermined, and preferably different, number of tablets. As discussed in more detail below, when the exit gate 24 of any chamber is in an open position, the tablets stored within the chamber 20 are released into an exit chute 30, and from the exit chute 30 the tablets are dispensed into a container 32. The fill gates and exit gates are preferably electromechanically controlled, e.g., with solenoids powered by the controller 34, to effect movement of the gates between open and closed positions.

The combination of the numbers of tablets within the plurality of chambers 20 is capable of comprising any number of tablets which is desired for dispensing. According to a preferred system, n chambers are provided, with $2^0$, $2^1$, $2^2$, . . . , $2^{n-1}$ tablets provided respectively in the individual chambers 20. Using such a system, any number of tablets, up to the additive combination of all the chambers (e.g., where n=8, the additive combination is 255), can be dispensed by selectively emptying the chambers which together add up to the selected number for dispensing.

As shown in FIG. 1, in an embodiment of the invention, seven chambers 20 are provided; i.e., n=7. The chambers are provided with tablets as follows: chamber one includes one tablet ($2^0$); chamber two includes two tablets ($2^1$); chamber three includes four tablets ($2^2$); chamber four includes eight tablets ($2^3$); chamber five includes sixteen tablets ($2^4$); chamber six includes thirty-two tablets ($2^5$); and chamber seven includes sixty-four tablets ($2^6$).

Figure 2:
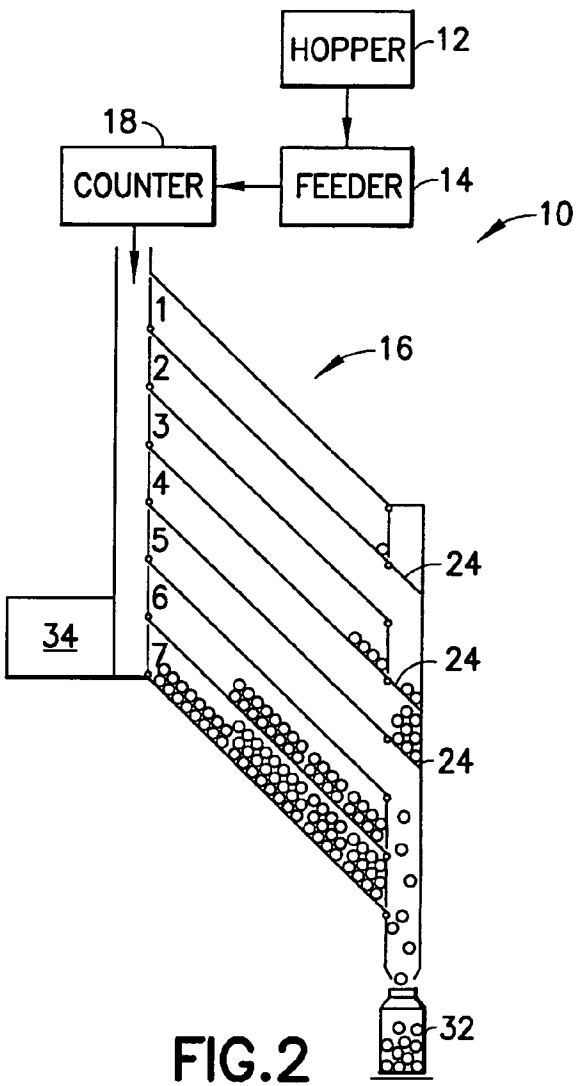
FIGS. 2, 3 and 4 are schematic views of the object counting and dispensing system of FIG. 1, showing a sequence for release and closure of exit gates.
Figure 4:
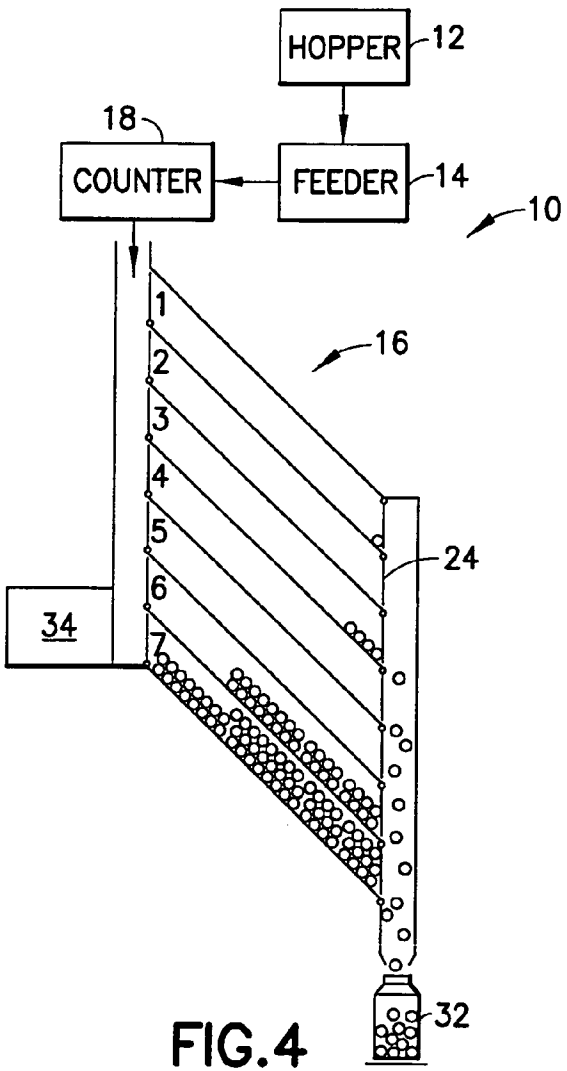
Figure 3:
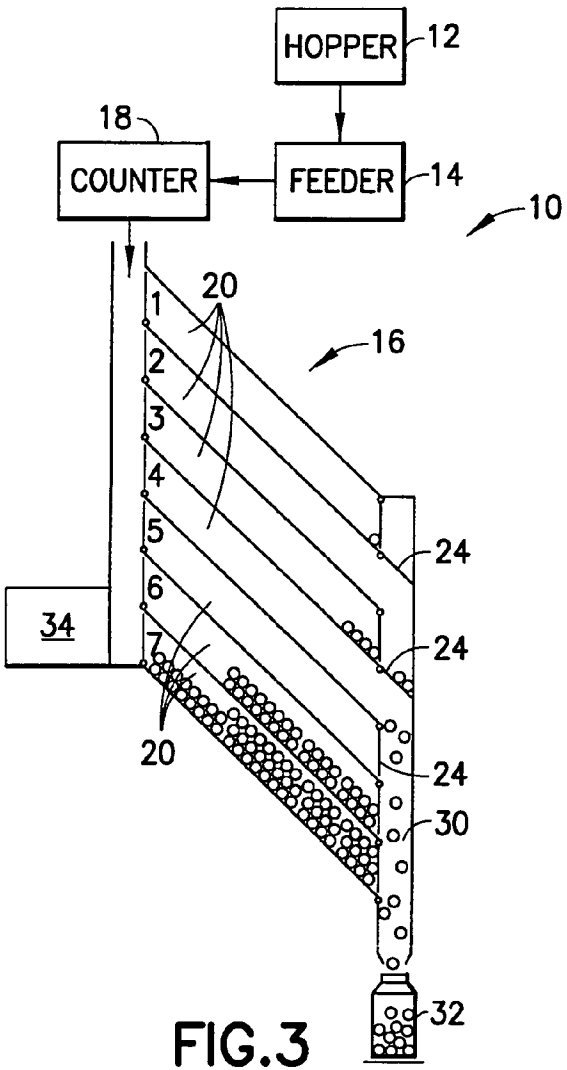

Referring to FIG. 2, if it is desired to dispense, e.g., twenty-six tablets, twenty-six tablets are selected at the controller 34 which causes the exit gates 24 of chambers two, four and five to be opened. The gates may be opened simultaneously. However, in the embodiment of the invention as shown, where the gates swing open, the gates are preferably opened in succession and at time intervals, e.g., 0.25 seconds between each opening, starting with the gate of the lowermost chamber. The time interval prevents jamming by the tablets. As the exit gates are opened, the tablets in the respective chambers (two, eight, and sixteen tablets, respectively) are released into the exit chute 30. The sixteen tablets from chamber five fall directly into the container, while the tablets from chambers four and two are retained the open exit gates of chambers five and four respectively. Referring to FIG. 3, the exit gates 24 are then closed from the bottom up, preferably again in succession and at a short time interval, to release the retained tablets into the chute 30 for dispensing. That is, when the exit gate 24 of chamber five is closed, the tablets from chamber four which were resting on that gate are released to fall through the exit chute 30 and into the container. Likewise, when the exit gate 24 of chamber four is closed, the two tablets retainer from chamber two fall into the container 32. Referring to FIG. 4, the exit gate 24 of chamber two, previously holding the two tablets is then closed.

As is discussed hereinafter, because the number of tablets in each of the particular chambers 20 is kept constant (due to refilling), the system optionally can be hardwired at the controller 34 to open the exit gates from the required chambers without any combinatorial computation process; i.e., for any number of tablets selected for dispensing, there always exists a particular readily determinable combination of chambers which can be emptied to comprise the selected number of tablets exactly, up to the maximum number of tablets stored in the cell 16.

Alternatively, the chambers can be selected by a simple computational process performed by the controller 34, for example, by first identifying the chamber having the largest number of tablets less than the selected number for dispensing, then identifying the chamber having the next largest number of tablets, provided that the addition of such number of tablets to the previously identified chamber does not exceed the selected number for dispensing, then identifying the chamber having the next largest number of tablets, provided that the addition of such number of tablets to the previously identified chambers does not exceed the selected number for dispensing, etc., until the desired number of tablets has been identified. As each chamber is identified, or after all have been identified, the exit gates are opened and closed, preferably in succession as described above, to dispense the tablets.

The tablet dispensing system requires no tablet counting time because the chambers of the cell are preloaded. The only time required is for the gates to open to release and empty the tablets from the identified chambers. While time is required to refill the emptied chambers, the refill occurs after dispensing and presumably while the system operator is completing the prescription requirement (e.g., labeling, data entry, packaging, etc.) or identifying and/or preparing the subsequent prescription information; i.e., refill occurs during system operator downtime.

Figure 6:
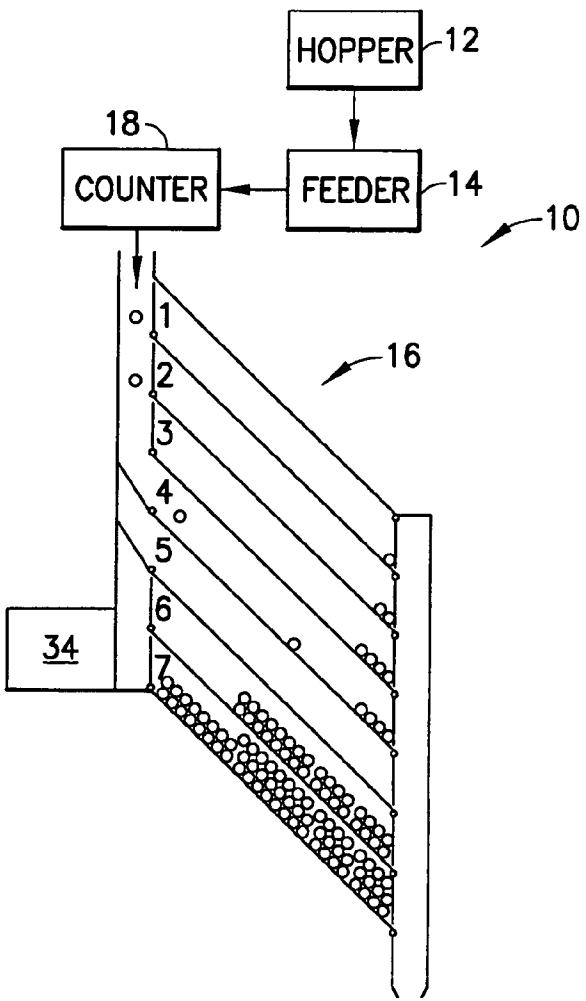
FIGS. 5, 6 and 7 are schematic views of the object counting and dispensing system of FIG. 1, showing a sequence for opening and closure of refill gates.
Figure 5:
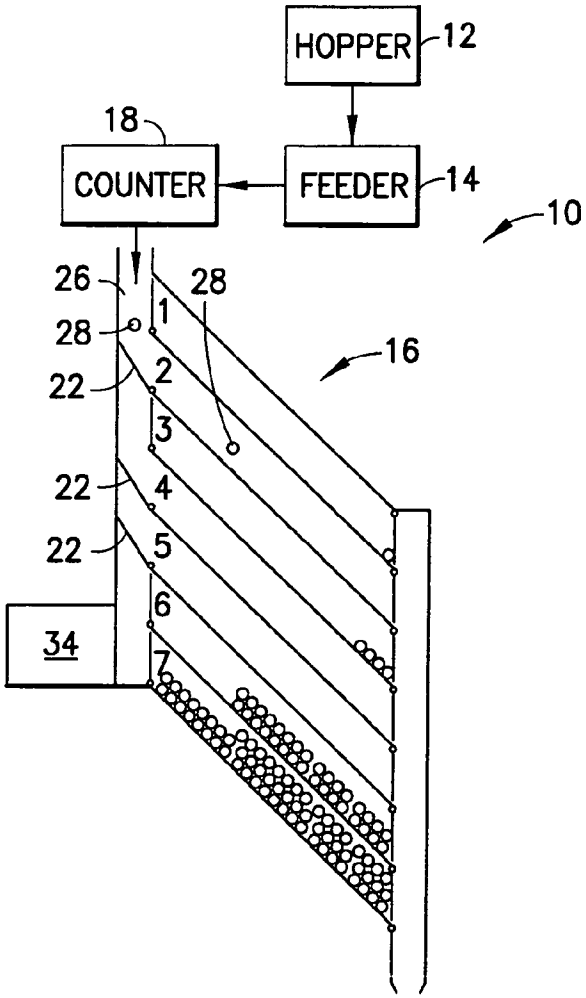
Figure 7:
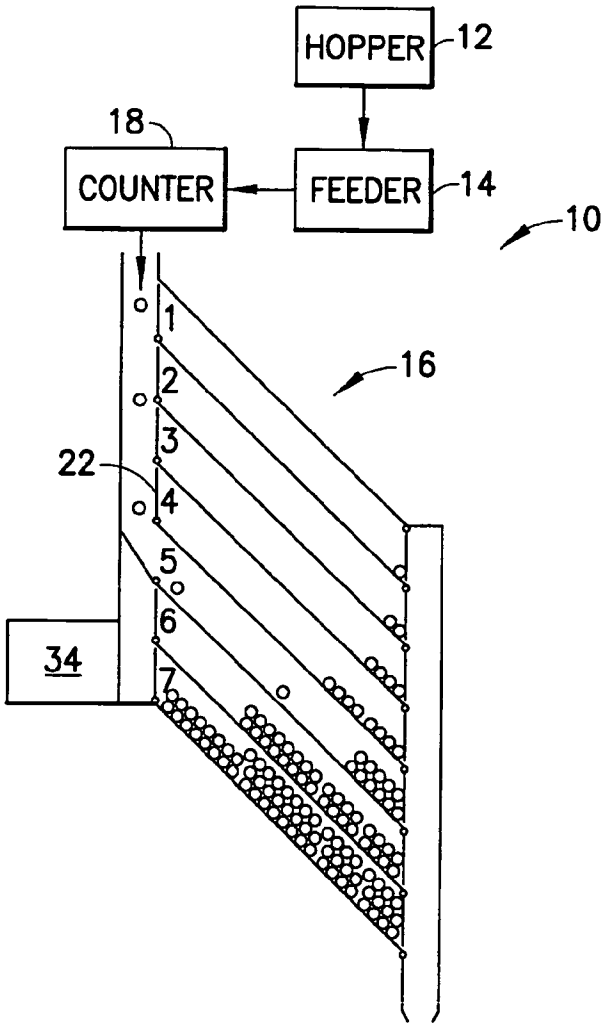

After the identified chambers have been emptied, such chambers need to be refilled for subsequent dispensing operations. Referring now to FIG. 5, the fill gates 22 of the emptied chambers (chambers two, four, and five in the example) are opened, and the tablets 28 are fed by the feeder 14 from the hopper 12 to the counter 18 (which is preferably an optical counter such as disclosed in co-owned U.S. Pat. No. 5,768,327). Once the counter counts the required number of tablets for the uppermost emptied chamber (chamber two), and after a short predetermined delay to permit the tablets to fall through the fill chute 26 to the respective chamber, the fill gate of that chamber is closed, as shown in FIG. 6. Still referring to FIG. 6, then the tablets required for the next chamber (i.e., chamber four) are counted, enter the fill chute and fall through the open fill gate to the chamber. Referring to FIG. 7, once chamber four is refilled, its respective fill gate 22 is closed, and chamber five is refilled in a like manner. It is appreciated that only those chambers which are emptied after dispensing need to be refilled and, as such, only the number of tablets in those chambers need to be counted. It is also appreciated that the dispensing system is initialized by counting and directing the required number of tablets to each of the respective chambers.

Figure 8:
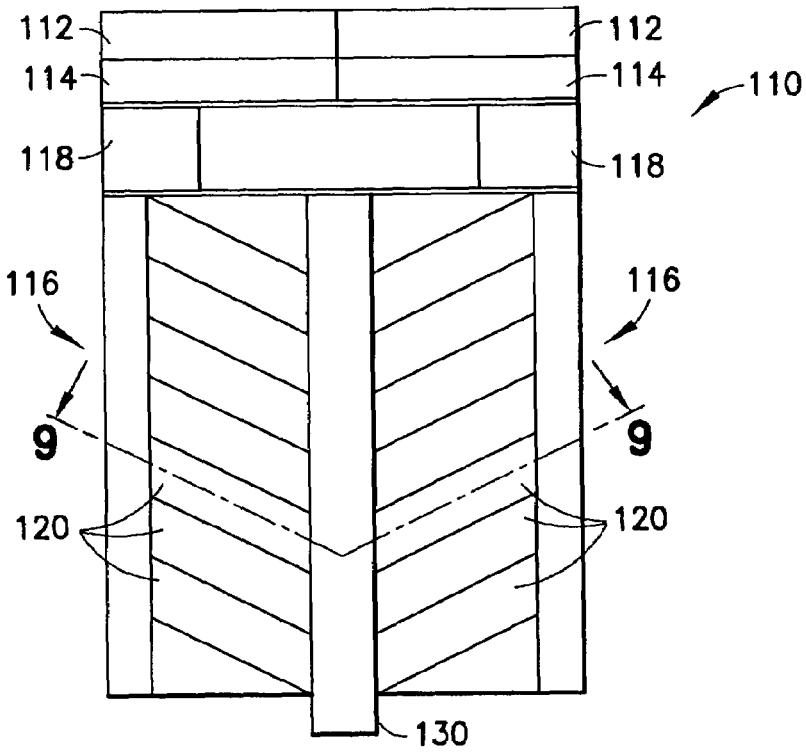
FIG. 8 is a schematic section of a side elevation view of a first embodiment of a multi-cell object counting and dispensing system.
Figure 9:
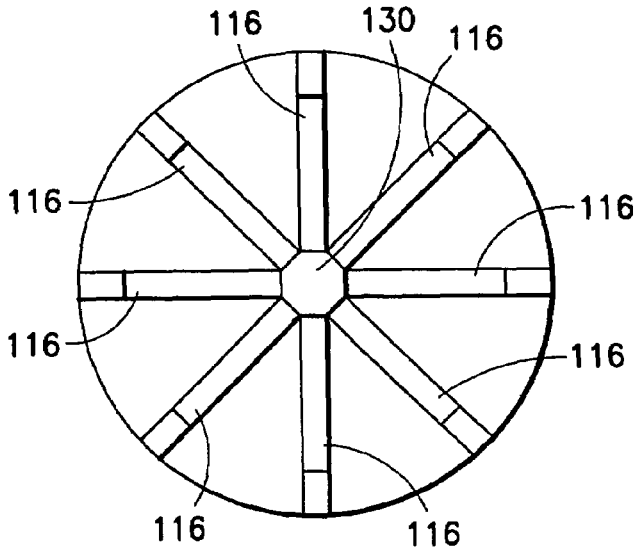
FIG. 9 is a schematic section view through line 9—9 in FIG. 8.

Referring to FIGS. 8 and 9, a tablet dispensing system 110 may include a plurality of radially arranged cells 116 each including a plurality of chambers 120 for a different solid dose medication. Each of the cells 116 is preferably provided with its own hopper 112, feeder 114 and counter 118. The solid dose medication may be selected from a controller (not shown) along with the number of tablets required to be dispensed. A common exit chute 130 can be used for dispensing into a bottle or container.

Figure 10:
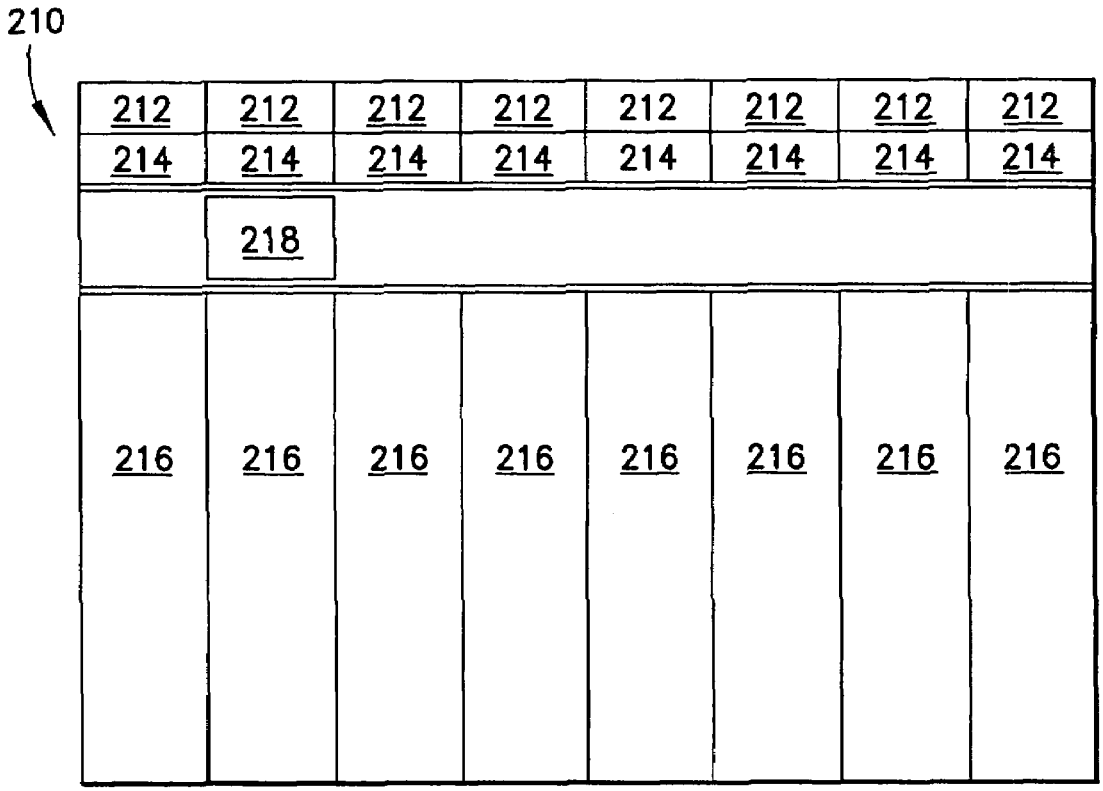
FIG. 10 is a schematic view of a second embodiment of a multi-cell object counting and dispensing system.

Turning now to FIG. 10, another embodiment of a multi-cell tablet dispensing system 210 is shown. Each cell 216 includes its own hopper 212 and preferably a feeder 214. A common counter 218 may be movable between the hoppers 212, feeders 214, and the cells 216. Alternatively, the feeder 214 may be integrated with the counter 218 and also movable relative to the hoppers 212 and cells 216. From the above multi-cell system embodiments, is understood that various other configurations of a multi-cell system may be implemented.

While the preferred system includes cells with n chambers provided with $2^0, 2^1, 2^2, \ldots, 2^{n-1}$ tablets in the respective chambers, it will be appreciated that chambers having another arrangement of tablet quantities may be used, provided that such arrangement permits the desired number of tablets to be dispensed. It is appreciated that not every number of tablet need be able to be dispensed, just those quantities which are generally prescribed. Prescribed quantities are generally in multiples of 7 or 10.

Figure 11:
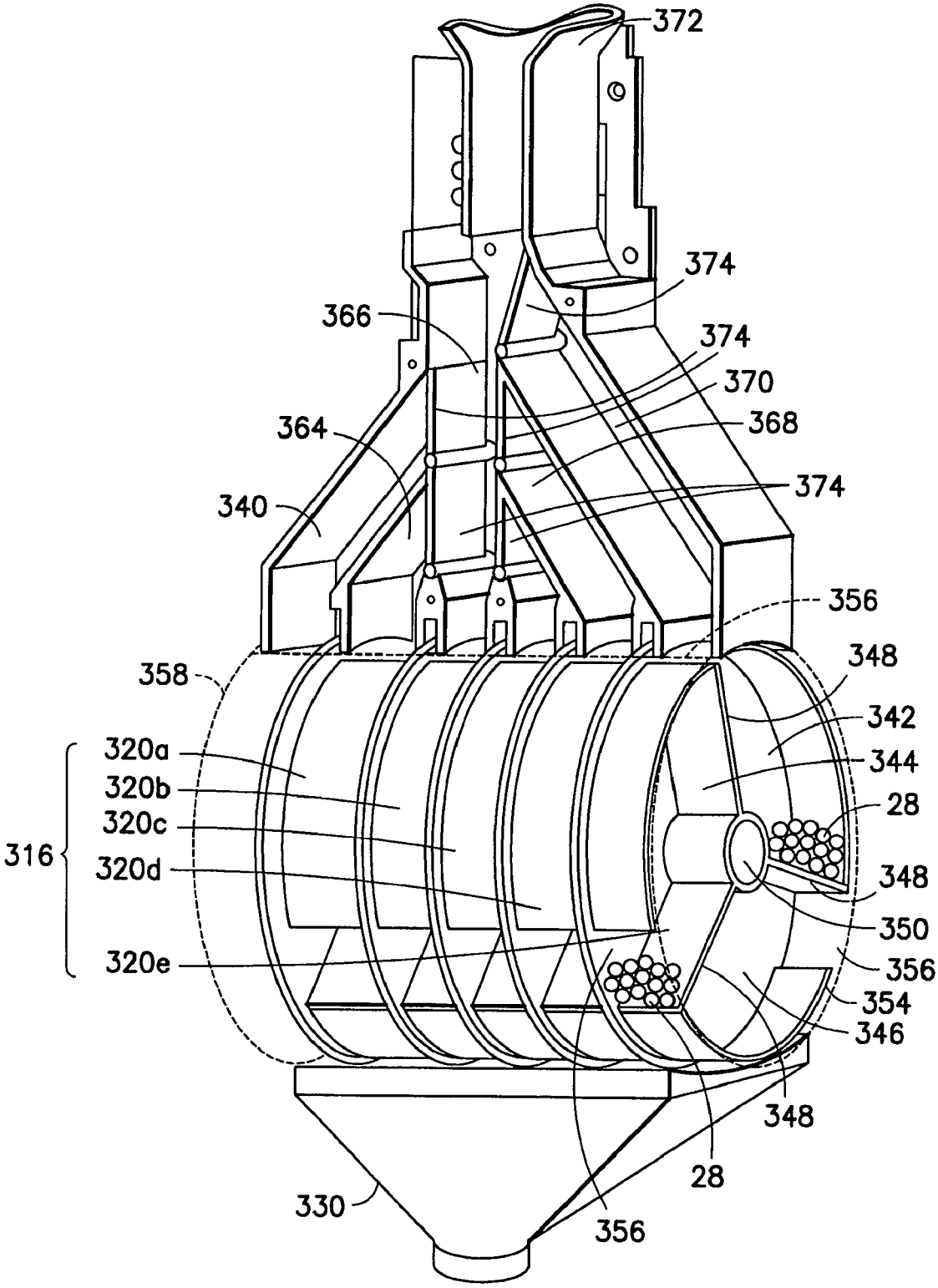
FIG. 11 is a perspective view of another embodiment of an object counting and dispensing system according to the invention.
Figure 12:
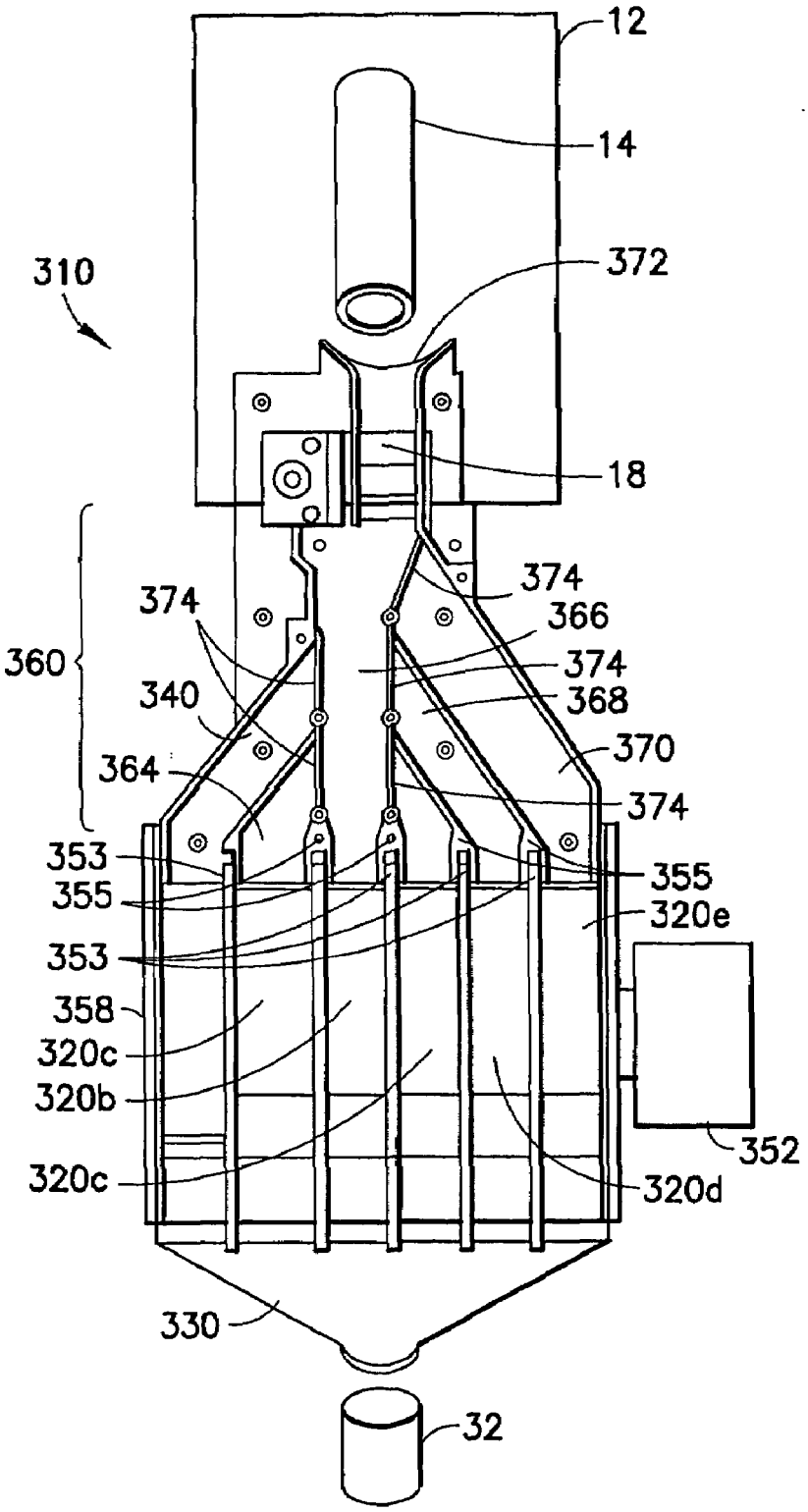
FIG. 12 is a schematic view of the system of FIG. 11.

Turning now to FIGS. 11 and 12, another embodiment of a dispensing system 310 for tablets is shown. The system 310 generally includes many of the features described above, including a hopper 12, a feeder 14, and a counter 18. The system 310 includes a cell 316 preferably having n primary chambers 320 for storing tablets, where n is preferably greater than or equal to four. The number of tablets in a particular chamber i is preferably $2^{i+2}$, where i=1 . . . n. Thus, for exactly four chambers 320, according to a presently preferred embodiment, a first chamber 320*a* preferably includes eight tablets, a second chamber 320*b* preferably includes sixteen tablets, a third chamber 320*c* preferably includes 32 tablets, and a fourth chamber 320*d* preferably includes 64 tablets. The cell 316 preferably also includes a fifth chamber 320*e*, the purpose of which is described further below. With four primary chambers, the chambers are adapted to dispense a large range of numbers of tablets, between 8 and 120 tablets, and even up to 240 using multiple chambers and double dispensing, as discussed below.

A direct feed channel 340 is provided in addition to the cell 316. The direct feed channel 340 provides automatic feed-through of individually counted tablets in a manner which bypasses the chambers 320 of the cell 316. The direct feed channel 340 is primarily provided for counting up to the number of tablets stored in the cell chamber having the fewest number of tablets. For example, if the first chamber 320*a* stores eight tablets, the direct feed channel 340 is provided for automatically feeding up to seven tablets into the chute 330. As such, for n=4, the chambers 320 in combination with the direct feed channel 340 permit dispensing of any number of tablets up to $$\sum_{i=1}^{n} 2^{i+2} + 7$$

(i.e., 127 tablets), without requiring three additional chambers for 1 ($2^0$), 2 ($2^1$) and 4 ($2^2$) tablets, as in the prior embodiments. Moreover, there is no need to direct feed more tablets than already pre-counted and stored in a chamber.

According to a preferred aspect of the invention, each chamber 320 preferably includes a plurality of subchambers, such as 342, 344, 346. Each of the subchambers 342, 344, 346 can be provided with the respective number of tablets for that chamber 320. That is, if a chamber 320 is designated to dispense eight tablets at a time, then each of the subchambers 342, 344, 346 is preferably provided with eight tablets, though it is appreciated that at any given time one or two of the subchambers may be emptied of tablets and awaiting refill. In a preferred embodiment, the chambers 320 are generally circular, with the subchambers 342, 344, 346 defined by sectors formed by radially extending walls 348 located 120° apart about a central hub 350. The chambers 320 are preferably mounted for individual mechanical rotational movement by a motorized actuation mechanism 352. The circumference of each circular chamber 320 includes a rim 353 which preferably extends within a stationary guide 355 at the bottom of the gateway 360, described below, to facilitate rotational alignment of the chambers 320. The chambers 320 also include an outer wall 354 provided with openings 356 into each of the subchambers. An enclosure 358, shown in broken lines, is provided partially about the cell 316 to retain tablets in the subchambers 342, 344, 346 and limit release of the tablets within the subchambers. The enclosure 358 has upper and lower apertures (not shown) which permit tablets to be received into the chamber and dispensed therefrom. When a subchamber is oriented in a first direction, e.g., vertically upwards, the subchamber is positioned to receive tablets fed through its opening via the gateway 360. When a subchamber is oriented vertically downwards, the subchamber is oriented to empty its tablet contents via its opening 356 into the chute 330. When a subchamber is oriented such that its opening is not adjacent the gateway 360 or chute 330, the subchamber and enclosure 358 merely store tablet contents.

Upon receiving an input for dispensing a certain number of tablets, the necessary chambers to comprise the largest number of tablets smaller than the input number are actuated, e.g., by rotation, to empty their contents. Alternatively, all chambers are rotated and only the necessary chambers (or subchambers) are emptied, e.g., by providing actuatable gates at the openings to the subchambers. If necessary, tablets are automatically fed into the direct feed channel 340 to complete the required number of tablets. For example, if an input is received to dispense ninety tablets, the fourth, second and first chambers are rotated to empty eighty-eight (64+16+8) tablets, and the direct feed provides an additional two tablets, for a total of ninety tablets.

According to another aspect of the invention, it may be desirable to be able to dispense a relatively large number of tablets by emptying more than one subchamber of a chamber. For example, if the number of tablets input for dispensing is one hundred-eighty, and the cell includes four primary chambers, each with three subchambers, of which two such subchambers of each chamber are preferably filled at any one time, the cell may be actuated to release two subchambers, each with sixty-four tablets from the fourth chamber 320*d*, one subchamber with thirty-two tablets from the third chamber 320*c*, and one subchamber of sixteen tablets from the second chamber 320*b*. Four tablets automatically fed from the feeder 14 to the direct feed channel 340 complete the request.

After a dispensing operation, tablets are fed from the feeder through the gateway 360 to the appropriate chambers for subchamber refilling. The gateway 360 is a series of channels including the above described direct feed channel 340 and chamber channels 364, 366, 368, 370 which direct tablets from a funnel 372 below the feeder 14 and into the chambers 320*a–e*. Appropriate channels 340, 364, 366, 368, 370 are selected by operation of a plurality of actuatable gates 374. The gates 374 are movable between opened and closed positions to, at any given time, define a single path for a tablet from the funnel 372 to one of the channels 340, 364, 366, 368, 370. This permits subchambers to be refilled with the designated number of tablets after a dispensing operation, as well as the output of individual tablets through the direct feed channel 340.

After a subchamber is filled with the appropriate number of tablets, it is possible that an additional tablet will have already been fed by the feeder 14 to the counter 18, but not yet counted. As such, after filling a chamber, the gates 374 move to a default position whereby such an extra tablet is provided to the fifth chamber 320*e*. The fifth chamber 320*e* operates as a temporary repository for such tablets. Generally, no more than one extra tablet would be counted per chamber. As such, with four chambers, up to four tablets may be provided to the fifth chamber upon each refill of the chambers. A count is kept of the tablets in the fifth chamber 320*e*, and the tablets in the fifth chamber are preferably dispensed along with the tablets in other appropriate chambers (i) when the number in the fifth chamber 320*e* is suitable in combination with one or more other chambers 320*a*, 320*b*, 320*c*, 320*d* to meet an input number of tablets for dispensing, or (ii) during every dispensing in combination with one or more other chambers and an appropriate number of tablets provided through the direct feed channel 340. Emptying the fifth chamber 320*e* whenever tablets are stored therein, regardless of how many tablets are in the fifth chamber, prevents inadvertent storage of a relatively large number of tablets which may be difficult to dispense in combination with the other chambers 320*a–d*.

In the above embodiment, it is recognized that the first chamber may be set to have more than eight tablets and that direct feed may be used for more than seven tablets. Moreover, while the chambers have been described as having exponentially incremented numbers of tablets, it is appreciated that it may be desirable to fill the chambers with numbers of tablets which are multiples of seven and/or ten, in view of the fact that most prescriptions comprise a number of tablets in a multiple of seven or ten. Moreover, the number of tablets designated for a particular chamber can be altered via software or hardware.

FIG. 12 is a flow chart that illustrates the operations performed by a controller to load tablets into a given subchamber i within the chambers 320*a–e*. It will be appreciated that this process is readily extended to load tablets into each subchamber within the chambers 320*a–e*, and can be used to initially load tablets into the subchambers as well as reload tablets into a subchamber after it has been emptied as described below. The operations begin in block B301 wherein the controller determines whether the subchamber i is empty and thus requires reloading of tablets. If not, the operation returns to wait until this condition is satisfied. If so, the operations continue to blocks B303 and B305. In block B303, the controller controls actuation of the gates of the feed channel (via electrical signals supplied thereto) to define a feed path from the counter to the circular chamber that includes subchamber i. It also controls rotation of this circular chamber (via electrical signals supplied to actuation mechanism 352) such that subchamber i is oriented vertically and tablets supplied thereto will pass through the opening in the outside wall of the circular chamber into the subchamber i. In block B305, the controller starts the feed of tablets into the counter and into the feed channel to initiate the fill operation for the subchamber i. The operations then continue to block B307.

In block B307, the controller monitors the count value output by the counter to determine whether this count value is less than the desired count value (which is the number of tablets to be loaded into the subchamber i). When this operation fails (the count value output by the counter is equal to the desired count value), the operations continue to blocks B309 and B311.

In block B309, the controller terminates the feed of tablets into the counter and into the feed channel to terminate the fill operation for the subchamber i.

In block B311, the controller controls actuation of the gates of the feed channel (via electrical signals supplied thereto) to define a feed path from the counter to the fifth chamber 320*e* (e.g., overflow chamber), thereby removing the supply path to the subchamber i. This terminates the fill operation for subchamber i after loading the desired number of tablets into the subchamber i. Any extra tablets that may be fed into the counter are stored in the fifth chamber 320*e* (e.g., overflow chamber).

It will be appreciated that the circular chambers 320*a–e* as described above provide logical groups of tablet storage containers (e.g., the group of three subchambers that make up a given circular chamber), wherein each group is associated with a given number of tablets. This feature enables high speed dispensing operations by selectively emptying one or more of the tablet storage containers that has been filled with the associated number of tablets.

In the exemplary embodiments described above, only one of the storage containers of a particular group is filled at a time, and one or more of the storage containers of the particular group is emptied at a time. These features provide for simple and efficient operation. Moreover, it is preferred that one of the storage containers of a particular group be capable of being filled simultaneously while another storage container of the particular group is emptied. This feature provides for decreased delays in filling the storage containers that would otherwise result in the event that such operations are performed sequentially.

It will be appreciated that the multi-chamber cell 316 as described above may be readily adapted for use in a multi-cell tablet dispensing system (FIG. 10). In this configuration, the cell is realized by a multi-chamber cell 316 and supporting elements as described above with respect to FIGS. 11 through 13. From the above multi-cell system embodiments, is understood that various other configurations of a multi-cell system may be implemented.

There have been described and illustrated herein several embodiments of a tablet dispensing system and a method of dispensing tablets. While particular embodiments of the invention have been described, it is not intended that the invention be limited thereto, as it is intended that the invention be as broad in scope as the art will allow and that the specification be read likewise. Thus, while the gates may be operated with a solenoid, it is appreciated that other means for moving the gates may be used. Also, while swinging gates have been disclosed, it will be appreciated that other types of gates can be utilized. In fact, if vertical space is provided between chambers, vertically moving gates may be utilized, and, in some embodiments, when vertically moving gates are utilized, all gates may be opened simultaneously, and all tablets may be dispensed immediately. In addition, while a particular number of chambers have been shown in each cell, it will be understood that other numbers of chambers may be used. Moreover, in one embodiment, while the number of tablets in each of the chambers is shown to increase with the successively lower located chambers, it is understood that the number of tablets designated for the chambers can be otherwise organized, e.g., a decreasing number of tablets as the chambers are located lower, or with another order to the number of tablets in relation to the location of the chambers. In addition, while a controller is shown, it is appreciated that the controller may comprise two or more discrete systems; e.g., a system which permits user input, a system which controls gate operation, a system which controls the feeder, and a system which communicates with the object counter to turn off the feeder once the required number of tablets have been counted. Also, while the system is described with respect to dispensing tablets, it will be appreciated that the system and method apply to the dispensing of other relatively small discrete objects. Furthermore, aspects of one embodiment may be combined with aspects of another embodiment. It will therefore be appreciated by those skilled in the art that yet other modifications could be made to the provided invention without deviating from its spirit and scope as claimed.

What is claimed is:

1. A system for dispensing discrete objects, comprising:

a) a plurality of primary chambers, each for holding a respective predetermined number of objects;

b) an overflow chamber for holding a variable number of objects;

c) means for inputting a number of the objects to be dispensed; and d) means for releasing a number of discrete objects from at least one of said primary chambers and said overflow chamber, the sum of the number of objects released from said primary chambers and said overflow chamber not exceeding said number of objects to be dispensed.

2. A system according to claim 1, further comprising:

a direct feed channel in which discrete objects are individually fed for dispensing and which bypasses said primary chambers and said overflow chamber.

3. A system according to claim 2, wherein:

said direct feed channel dispenses individual objects in combination with said plurality of primary chambers.

4. A system according to claim 1, further comprising:

e) a hopper which stores bulk quantities of the objects;

f) a feeder which feeds objects from said hopper;

g) a counter which counts the objects fed by the feeder; and h) at least one path extending between said feeder and said plurality of primary chambers and said overflow chamber.

5. A system according to claim 4, further comprising:

a gateway system, wherein said at least one path comprises discrete paths extending between said feeder and each of said primary chambers and said overflow chamber, wherein at any one time said gateway system is configured to define at most a single path between said feeder and one of said primary chambers and said overflow chamber.

6. A system according to claim 1, wherein:

said primary chambers each hold a different number of objects.

7. A system according to claim 6, wherein:

said primary chambers includes n chambers, and a number of tablets in a particular chamber i is 2i+2, where i=1 . . . n.

8. A system according to claim 1, wherein:

each said primary chamber comprises a plurality of subchambers, each for holding said respective predetermined number of tablets.

9. A system according to claim 8, wherein:

each said subchamber includes an opening, and said chamber has a first rotational position in which said first subchamber is oriented for receiving objects through said opening, and a second rotational position in which said first subchamber is oriented for emptying objects contained within said first subchamber through said opening.

10. A discrete object dispensing system according to claim 1, further comprising:

a control means adapted to perform a computational process to determine a combination of said primary chambers to dispense a selected number of the objects.

* * * * *